US007569092B2

(12) United States Patent
Margaria et al.

(10) Patent No.: US 7,569,092 B2
(45) Date of Patent: Aug. 4, 2009

(54) INOCULANT PRODUCTS COMPRISING BISMUTH AND RARE EARTHS

(75) Inventors: Thomas Margaria, Chambery (FR); Roland Siclari, Pompey (FR)

(73) Assignee: Pechiney Electrometallurgie, Chambery (FR)

( * ) Notice: Subject to any disclaimer, the term of this patent is extended or adjusted under 35 U.S.C. 154(b) by 595 days.

(21) Appl. No.: 10/555,786

(22) PCT Filed: May 13, 2004

(86) PCT No.: PCT/FR2004/001167

§ 371 (c)(1), (2), (4) Date: Dec. 14, 2005

(87) PCT Pub. No.: WO2004/104252

PCT Pub. Date: Dec. 2, 2004

(65) Prior Publication Data

US 2006/0113055 A1 Jun. 1, 2006

(30) Foreign Application Priority Data

May 20, 2003 (FR) ..... 03 06033

(51) Int. Cl.
*C21C 1/10* (2006.01)

(52) U.S. Cl. ..... 75/305; 148/618

(58) Field of Classification Search ..... 75/303, 75/305, 314, 328, 526, 245–254, 10.5, 10.51; 148/618; 420/578, 580, 581
See application file for complete search history.

(56) References Cited

U.S. PATENT DOCUMENTS

| | | | | | |
|---|---|---|---|---|---|
| 4,290,805 | A | * | 9/1981 | Gorgerino et al. | 420/30 |
| 4,414,027 | A | * | 11/1983 | Gorgerino et al. | 420/578 |
| 4,432,793 | A | * | 2/1984 | Hilaire et al. | 420/30 |
| 5,087,290 | A | | 2/1992 | Wolfsgruber et al. | |
| 5,209,901 | A | * | 5/1993 | Reifferscheid et al. | 420/578 |
| 5,733,502 | A | * | 3/1998 | Margaria et al. | 420/578 |
| 6,102,983 | A | | 8/2000 | Skaland | |
| 2005/0180876 | A1 | * | 8/2005 | Margaria | 420/28 |

FOREIGN PATENT DOCUMENTS

| | | | | |
|---|---|---|---|---|
| EP | 0 162 194 | A1 | | 11/1985 |
| EP | 0 357 521 | A1 | | 3/1990 |
| EP | 0 816 522 | A1 | | 1/1998 |
| EP | 1 126 037 | A1 | | 8/2001 |
| FR | 2 511 044 | | | 2/1983 |
| FR | WO 2003/093514 | A3 | * | 11/2003 |

* cited by examiner

*Primary Examiner*—George Wyszomierski
*Assistant Examiner*—Mark L Shevin
(74) *Attorney, Agent, or Firm*—Oliff & Berridge, PLC

(57) ABSTRACT

The invention relates to an inoculant mixture for the treatment of molten cast iron, comprising 5 to 75% by weight of a ferro-silicon alloy of type A where Si/Fe>2, containing 0.005 to 3% by weight of rare earths, 0.005 to 3% bismuth, lead and/or antimony and less than 3% calcium, with a ratio (Bi+Pb+Sb)/TR of between 0.9 and 2.2 and 25 to 95% of at least one alloy of type B, based on silicon or ferro-silicon such that Si/Fe>2, containing calcium to a level such that the total amount of calcium in the mixture is from 0.3 to 3%. The above mixtures have a good granulometric stability over time and provide an efficient inoculation of cast pieces, in particular of thin pieces.

18 Claims, No Drawings

INOCULANT PRODUCTS COMPRISING BISMUTH AND RARE EARTHS

FIELD OF THE INVENTION

The invention relates to the treatment in the liquid state of cast iron intended for the manufacture of thin castings for which it is desired to obtain a structure free of iron carbides, and more particularly to inoculant products based on ferro-silicon and containing bismuth, lead and/or antimony, and also rare earths.

PRIOR ART

Cast iron is an iron-carbon alloy well known and widely used for the manufacture of castings. It is known that, in order to obtain good mechanical properties on these castings, it is necessary in the end to obtain an iron/graphite structure, while avoiding as far as possible the formation of iron carbides of the $Fe_3C$ type, which embrittle the alloy.

The graphite in cast iron castings may be present either in lamellar form (gray cast iron or lamellar graphite cast iron called LG cast iron) or in the form of spheroids (spheroidal graphite cast iron or SG cast iron). Gray cast iron has been known for the longest time and is used for the manufacture of castings. Owing to its low toughness due to the presence of lamellar graphite, gray graphite is applicable only for castings that are not highly stressed, whereas spheroidal graphite cast iron has found, right from its discovery in 1945, many applications for mechanical parts that are highly stressed.

Whether using LG cast iron or SG cast iron, the technical objective of the foundryman is to encourage the appearance of graphite during solidification of liquid cast iron, and it is well known that, the more rapid the solidification of the cast iron, the higher the risk of the carbon contained in the cast iron appearing in the form of iron carbide $Fe_3C$. This explains the difficulty encountered in manufacturing thin castings containing little iron carbide.

To solve the problem, the liquid cast iron has to undergo what is called an inoculation treatment by the addition of a ferro-alloy, generally ferro-silicon, which, once it has dissolved, causes ephemeral crystallization nuclei to appear locally, these nuclei promoting the precipitation of what is called primary graphite as this is the first solid to appear in the liquid medium.

The efficacy of the inoculants can be determined either through the quench-hardening depth measured on a standardized quench-hardening test piece, or through the density of the crystallization nuclei created in the liquid cast iron. This density may be determined by subjecting the cast iron to a nodularization treatment so that, during solidification, the graphite appears in nodular form, and thus, by micrographic examination of the castings obtained, will give a density of nodules corresponding to the density of nuclei.

Among the most efficacious of the inoculants of the prior art, mention may in particular be made of the alloys sold under the trademark "Sphérix" described in patents FR 2 511 044 (Nobel-Bozel) and EP 0 816 522 in the name of the Applicant. These alloys contain about 72% silicon, 0.8 to 1.3% bismuth, 0.4 to 0.7% rare earths, about 1.5% calcium and 1% aluminum by weight, the balance being iron.

These alloys are particularly well suited to the treatment of cast iron intended for the manufacture of castings having parts of small thickness; however, in the thin regions it is found that there is an increase in graphite nodule density, which impairs the structural homogeneity of the castings.

However, the mechanical behavior and the stability of alloys of this type may pose a few problems. This is because, in the solid state, they inevitably contain a $Bi_2Ca_3$ phase that collects at the grain boundaries of the FeSi phase. As this phase is an intermetallic compound that reacts on contact with water, it is liable to decompose if the alloy is exposed to atmospheric moisture. Grain degradation of the alloy is then observed, with numerous fine particles being generated, typically less than 200 μm in size. The optional addition of strontium or barium to the alloy only increases this tendency.

Patent EP 0 816 522 has a provided a solution to this problem by the addition of 0.3 to 3% magnesium to the alloy, this having effect of engaging the bismuth in a Bi—Ca—Mg ternary phase that is more stable with respect to water than the $Bi_2Ca_3$ phase. Experiments have confirmed that alloys of the "Sphérix" type doped by the addition of magnesium do indeed exhibit better grain stability than alloys without magnesium. However, a few cases of poor grain behavior over the course of time have been encountered without any particular cause being identified.

The object of the invention is to remedy these drawbacks and to provide inoculants that are more efficacious and exhibit better grain stability over time than the inoculants of the prior art.

SUBJECT OF THE INVENTION

The subject of the invention is an inoculant blend for the treatment of liquid cast iron, consisting of 5 to 75% by weight of at least one alloy of type A based on ferro-silicon such that Si/Fe>2, containing, by weight, 0.005 to 3% rare earths (RE), 0.005 to 3% bismuth, lead and/or antimony, and less than 3% calcium, with a (Bi+Pb+Sb)/RE ratio of between 0.9 and 2.2 per 25 to 95% of at least one alloy of type B based on silicon or ferro-silicon such that Si/Fe>2, containing calcium with a content such that the total calcium content of the blend is between 0.3 and 3%.

Alloy A may also contain magnesium, with a content of between 0.3 and 3%. The bismuth content of alloy A is preferably between 0.2 and 0.6% and its calcium content is preferably less than 2%, and more preferably less than 0.8%. Preferably, lanthanum represents more than 70% of the total mass of the rare earths of alloy A. Preferably, alloy B contains less than 0.01% bismuth, lead and/or antimony. The total calcium of the blend is preferably provided by alloy B for one part of between 75 and 95%, and more preferably between 80 and 90%. The total bismuth content of the blend is preferably between 0.05 and 0.3%, its total content of rare earths is between 0.04 and 0.15% and its total oxygen content is less than 0.2%.

DESCRIPTION OF THE INVENTION

With a concern for improving the grain stability of its products and their behavior over time, trials carried out by the Applicant have shown, surprisingly, the benefit of replacing alloys of the "Sphérix" type with a blend of alloys, leading to a practically identical overall composition containing, on the one hand, an alloy A of the same type, preferably with a lower calcium content, typically less than 2% or even less than 0.8%, and, on the other hand, an alloy B of the ferro-silicon type with a silicon content of preferably between 70 and 80%, containing practically no, typically less than 0.01%, bismuth but on the contrary having a higher calcium content in such a way that the blend of these two alloys gives again the composition of a conventional alloy.

Alloy B may also be a silicon-calcium alloy with a silicon content of between 54 and 68% and a calcium content of between 25 and 42%.

The blend may be in the form of grains with a size of less than 7 mm, or a powder with a particle size of less than 2.2 mm.

In terms of grain stability, this type of blend has been confirmed as being a more efficacious solution than that disclosed in EP 0 816 522 as it ensures that the grains are stable over time. In particular, it is possible to ensure a grain degradation factor, defined as the mass fraction below 200 μm appearing in 24 h on contact with water, of less than 10% and preferably less than 5%, even after a storage time of more than one year, something which the alloy of the prior art is absolutely incapable of.

In addition, it has been found quite unexpectedly that the inoculability of the blend was appreciably higher than that of the alloy of equivalent composition, to the point that inoculation of the cast iron could be carried out with an appreciably lower amount of active elements—bismuth and rare earths—than that used in the inoculation implemented with the conventional alloy. It has also been observed that the different inoculability between a blend and an alloy of equivalent composition is more pronounced the lower the bismuth content.

Now, since the "Spherix"-type alloys are particularly designed for the treatment of cast iron used for the manufacture of thin castings, it is advantageous to use an alloy with a relatively low bismuth content in order to prevent an increase in graphite nodule density in the thin regions, without reducing the inoculability of the alloy.

Thus, with a bismuth content of below 0.6%, the inoculant blend gives shallower quench-hardening depths than the alloy and prevents an excessively large increase in graphite nodule density in the thinnest sections of the castings.

EXAMPLES

Example 1

Ten batches of "Spherix"-type inoculant alloys, the composition (in % by weight) of which is indicated in Table 1, were prepared in the grain range 0.2-0.7 mm:

TABLE 1

| Batch | Si | Ca | Al | Bi | RE | Mg |
|---|---|---|---|---|---|---|
| A | 74.5 | 1.17 | 0.87 | 1.15 | 0.62 | |
| B | 73.9 | 1.15 | 0.91 | 1.16 | 0.63 | 1.05 |
| C | 74.3 | 1.18 | 0.85 | 0.61 | 0.30 | |
| D | 73.7 | 1.17 | 0.82 | 1.14 | 0.60 | 0.25 |
| E | 74.7 | 0.23 | 0.82 | 1.14 | 0.60 | 0.25 |
| F | 72.7 | 1.21 | 0.84 | 0.29 | 0.15 | |
| G | 73.1 | 0.17 | 0.67 | 0.30 | 0.16 | 0.21 |
| H | 73.8 | 1.55 | 0.71 | | | |
| I | 74.5 | 2.25 | 0.86 | | | |
| J | 66.3 | 1.65 | 0.82 | 0.75 (Ba) | 0.82 (Zr) | |

From these products the following were prepared:

inoculant blend K containing 500 g of E and 500 g of I;

inoculant blend L containing 250 g of E and 750 g of H;

inoculant blend M containing 125 g of E and 875 g of H;

inoculant blend N containing 50 g of E and 950 g of H;

inoculant blend C containing 125 g of E and 875 g of J; and inoculant blend P containing 50 g of E and 950 g of J.

Example 2

A particle size analysis was carried out on specimens taken from batches A to F, K and L before and after direct contact with water at 20° C. for 24 h.

The percentage by weight of grains smaller in size than 200 μm is indicated in Table 2:

TABLE 2

| Specimen | A | B | C | D | E | F | G | K | L |
|---|---|---|---|---|---|---|---|---|---|
| Initial | 3 | 2.5 | 3 | 2.5 | 2.5 | 2.5 | 2 | 2 | 2 |
| After 24 h | 67 | 24 | 56 | 14 | 8 | 48 | 5 | 6 | 3.5 |

Example 3

A charge of fresh cast iron was melted in an induction furnace and treated by the Tundish Cover process using an alloy of the FeSiMg type containing 5% Mg, 1% Ca and 0.56% rare earths, with a dose of 25 kg per 1600 kg of cast iron.

The composition of this liquid cast iron was:

C=3.5%; Si=1.7%; Mn=0.08%; P=0.02%; S=0.003%.

This cast iron was jet-inoculated by means of inoculant alloy B used with a dose of 1 kg per tonne of cast iron. It was used to manufacture a plate 24 mm in thickness having, in a perpendicular position, fins 6 and 2 mm in thickness.

The observed graphite nodule density was 487/mm$^2$ in the core of the 24 mm thick region, 1076/mm$^2$ in the core of the 6 mm thick region and 1283/mm$^2$ in the core of the 2 mm thick region.

Example 4

The previous example was repeated, jet-inoculating the cast iron by means of inoculant alloy B used with a dose of 1 kg per tonne of cast iron.

This liquid cast iron was used to manufacture a plate 24 mm in thickness having, in a perpendicular position, fins 6 and 2 mm in thickness.

The observed graphite nodule density was 304/mm$^2$ in the core of the 24 mm thick region, 631/mm$^2$ in the core of the 6 mm thick region and 742/mm$^2$ in the core of the 2 mm thick region.

Example 5

The trial of Example 3 was repeated under the same conditions, but the cast iron was jet-inoculated by means of inoculant alloy G used with a dose of 1 kg per tonne of cast iron.

This liquid cast iron was used to manufacture a plate 24 mm in thickness having, in a perpendicular position, fins 6 and 2 mm in thickness.

The observed graphite nodule density was 209/mm$^2$ in the core of the 24 mm thick region, 405/mm$^2$ in the core of the 6 mm thick region and 470/mm$^2$ in the core of the 2 mm thick region.

In these examples 3, 4 and 5, it was found that the efficacy of the inoculant rapidly decreases with its bismuth content and that the structure of the cast iron obtained is always finer in the thinner sections.

Example 6

The trial of Example 3 was repeated under the same conditions, but the cast iron was jet-inoculated by means of inoculant blend K used with a dose of 1 kg per tonne of cast iron.

This liquid cast iron was used to manufacture a plate 24 mm in thickness having, in a perpendicular position, fins 6 and 2 mm in thickness.

The observed graphite nodule density was 343/mm$^2$ in the core of the 24 mm thick region, 705/mm$^2$ in the core of the 6 mm thick region and 828/mm$^2$ in the core of the 2 mm thick region.

Example 7

The trial of Example 4 was repeated under the same conditions, but the cast iron was jet-inoculated by means of inoculant blend L used with a dose of 1 kg per tonne of cast iron.

This liquid cast iron was used to manufacture a plate 24 mm in thickness having, in a perpendicular position, fins 6 and 2 mm in thickness.

The observed graphite nodule density was 269/mm$^2$ in the core of the 24 mm thick region, 518/mm$^2$ in the core of the 6 mm thick region and 600/mm$^2$ in the core of the 2 mm thick region.

Example 8

The trial of Example 5 was repeated under the same conditions, but the cast iron was jet-inoculated by means of inoculant blend M used with a dose of 1 kg per tonne of cast iron.

The trial of Example 6 was repeated replacing inoculant blend L with inoculant blend M used with a dose of 1 kg per tonne of cast iron.

This liquid cast iron was used to manufacture a plate 24 mm in thickness having, in a perpendicular position, fins 6 and 2 mm in thickness.

The observed graphite nodule density was 234/mm$^2$ in the core of the 24 mm thick region, 425/mm$^2$ in the core of the 6 mm thickness region and 486/mm$^2$ in the core of the 2 mm thickness region.

Comparison between Examples 3, 4 and 5 and Examples 6, 7 and 8 is given in Table 3.

TABLE 3

| Dose: 1 kg/t | Alloys | | | Blends | | |
|---|---|---|---|---|---|---|
| Cast iron thickness | 24 | 6 | 2 | 24 | 6 | 2 |
| 1.2% Bi | 487 | 1076 | 1283 | | | |
| 0.6% Bi | 304 | 631 | 742 | 343 | 705 | 828 |
| 0.3% Bi | 209 | 405 | 470 | 269 | 518 | 600 |
| 0.15% Bi | | | | 234 | 425 | 486 |

This shows that:

1) the efficacy of the blends decreases with the bismuth content, but more slowly than that of the alloys of the same composition; and
2) the increase in number of nodules per mm2 in the thin sections, which is very high in the case of the alloys, is markedly less in the case of the blends.

Example 9

The trial of Example 7 was repeated using inoculant blend L with a dose of 1.5 kg per tonne of cast iron.

This liquid cast iron was used to manufacture a plate 24 mm in thickness having, in a perpendicular position, fins 6 and 2 mm in thickness.

The observed graphite nodule density was 309/mm$^2$ in the core of the 24 mm thick region, 536/mm$^2$ in the core of the 6 mm thick region and 607/mm$^2$ in the core of the 2 mm thick region.

Example 10

The trial of Example 8 was repeated using inoculant blend M with a dose of 1.5 kg per tonne of cast iron.

This liquid cast iron was used to manufacture a plate 24 mm in thickness having, in a perpendicular position, fins 6 and 2 mm in thickness.

The observed graphite nodule density was 266/mm$^2$ in the 2 core of the 24 mm thick region, 440/mm$^2$ in the core of the 6 mm thick region and 491/mm$^2$ in the core of the 2 mm thick region.

Example 11

The trial of Example 9 was repeated using inoculant blend N with a dose of 1.5 kg per tonne of cast iron.

This liquid cast iron was used to manufacture a plate 24 mm in thickness having, in a perpendicular position, fins 6 and 2 mm in thickness.

The observed graphite nodule density was 247/mm$^2$ in the core of the 24 mm thick region, 383/mm$^2$ in the core of the 6 mm thick region and 422/mm$^2$ in the core of the 2 mm thick region.

Comparison between Examples 6, 7, 8 and 9 and Examples 10 and 11 is given in Table 4.

TABLE 4

| Blends | Dose 1 kg/t | | | Dose 1.5 kg/t | | |
|---|---|---|---|---|---|---|
| Cast iron thickness | 24 | 6 | 2 | 24 | 6 | 2 |
| 0.6% Bi | 343 | 705 | 828 | | | |
| 0.3% Bi | 269 | 518 | 600 | 309 | 536 | 607 |
| 0.15% Bi | 234 | 425 | 486 | 266 | 440 | 491 |
| 0.05% Bi | | | | 247 | 383 | 422 |

This table shows that:

1) it is possible to at least partly compensate for the lower efficacy of the inoculant with its bismuth content, by increasing the quantity of inoculant used, while employing a smaller amount of bismuth; and
2) by using more inoculant with a lower bismuth content, the sensitivity of the number of nodules per mm$^2$ with respect to the thickness of the casting is also reduced.

Example 12

The trial of Example 10 was repeated using inoculant blend O with a dose of 1.5 kg per tonne of cast iron.

This liquid cast iron was used to manufacture a plate 24 mm in thickness having, in a perpendicular position, fins 6 and 2 mm in thickness.

The observed graphite nodule density was 273/mm$^2$ in the core of the 24 mm thick region, 457/mm$^2$ in the core of the 6 mm thick region and 517/mm$^2$ in the core of the 2 mm thick region.

Example 13

The trial of Example 11 was repeated using inoculant blend P with a dose of 1.5 kg per tonne of cast iron.

This liquid cast iron was used to manufacture a plate 24 mm in thickness having, in a perpendicular position, fins 6 and 2 mm in thickness.

The observed graphite nodule density was 260/mm$^2$ in the core of the 24 mm thick region, 410/mm$^2$ in the core of the 6 mm thick region and 459/mm$^2$ in the core of the 2 mm thick region.

The results of Examples 12 and 13 show that, by combining several inoculants in one blend, including an inoculant even with a low proportion of bismuth, it is possible to appreciably reduce the disparities in structure that are obtained in the cast iron castings having very different thickness sections.

The invention claimed is:

1. An inoculant blend for the treatment of liquid cast iron, consisting of 5 to 75% by weight of at least one alloy of type A based on ferro-silicon such that Si/Fe>2, containing, by weight, 0.005 to 3% rare earths (RE), 0.05 to 3% bismuth, lead and/or antimony, and less than 3% calcium, with a (Bi+Pb+Sb)/RE ratio of between 0.9 and 2.2 per 25 to 95% of at least one alloy of type B based on silicon or ferro-silicon such that Si/Fe>2, containing less than 0.01% bismuth and calcium with a content greater than that of alloy A, such that the total calcium content of the blend is between 0.3 and 3%.

2. The inoculant blend as claimed in claim 1, wherein it is in the form of grains having a size of less than 7 mm or powder with a particle size of less than 2.2 mm.

3. The inoculant blend as claimed in claim 1, wherein alloy A contains 0.3 to 3% magnesium.

4. The inoculant blend as claimed in claim 1, wherein alloy A contains 0.2 to 0.6% bismuth.

5. The inoculant blend as claimed in claim 1, wherein alloy A contains less than 2% calcium.

6. The inoculant blend as claimed in claim 5, wherein alloy A contains less than 0.8% calcium.

7. The inoculant blend as claimed in claim 1, wherein lanthanum represents more than 70% of the rare earths of alloy A.

8. The inoculant blend as claimed in claim 1, wherein alloy B contains less than 0.0 1% bismuth, lead and/or antimony.

9. The inoculant blend as claimed in claim 1, wherein alloy B provides between 75% and 95% of the total calcium in the inoculant blend.

10. The inoculant blend as claimed in claim 9, wherein alloy B provides between 80 and 90% of the total calcium in the inoculant blend.

11. The inoculant blend as claimed in claim 1, wherein its total bismuth content is between 0.05 and 0.3%.

12. The inoculant blend as claimed in claim 1, wherein its total content of rare earths is between 0.04 and 0.15%.

13. The inoculant blend as claimed in claim 1, wherein its total oxygen content is less than 0.2%.

14. The inoculant blend as claimed in claim 1, wherein it gives rise, on contact with water at 20° C., to a grain degradation factor, defined as the mass fraction in the 0 to 200 μm range appearing in 24 hours, of less than 10%.

15. The inoculant blend as claimed in claim 14, wherein its grain degradation factor is less than 5%.

16. The inoculant blend as claimed in claim 1, wherein alloy B or one of the alloys B is based on ferro-silicon with a silicon content of between 70 and 80%.

17. The inoculant blend as claimed in claim 1, wherein one of the alloys B is a silicon-calcium alloy with a silicon content of between 54% and 68% and a calcium content of between 25 and 42%.

18. A method for manufacturing cast iron castings having parts with a thickness of less than 6 mm that comprises utilizing the inoculant blend of claim 1.

* * * * *